US009022759B2

(12) United States Patent
Magadum et al.

(10) Patent No.: US 9,022,759 B2
(45) Date of Patent: May 5, 2015

(54) CAPACITY MODULATED SCROLL COMPRESSOR

(71) Applicant: Emerson Climate Technologies, Inc., Sidney, OH (US)

(72) Inventors: Sunil Annappa Magadum, Pune (IN); Vinayak Madanrao Juge, Pune (IN)

(73) Assignee: Emerson Climate Technologies, Inc., Sidney, OH (US)

( * ) Notice: Subject to any disclaimer, the term of this patent is extended or adjusted under 35 U.S.C. 154(b) by 46 days.

(21) Appl. No.: 13/958,904

(22) Filed: Aug. 5, 2013

(65) Prior Publication Data

US 2014/0064999 A1 Mar. 6, 2014

(30) Foreign Application Priority Data

Aug. 31, 2012 (IN) ..... 2537MUM2012

(51) Int. Cl.

| | |
|---|---|
| ***F04C 2/00*** | (2006.01) |
| ***F04C 18/00*** | (2006.01) |
| ***F03C 2/00*** | (2006.01) |
| ***F04C 15/00*** | (2006.01) |
| ***F04C 28/26*** | (2006.01) |
| ***F04C 29/12*** | (2006.01) |
| ***F04C 18/02*** | (2006.01) |
| *F04C 23/00* | (2006.01) |

(52) U.S. Cl.

CPC ..... *F04C 28/265* (2013.01); *F04C 29/126* (2013.01); *F04C 23/008* (2013.01); *F04C 28/26* (2013.01); *F04C 18/0215* (2013.01); *F04C 2270/19* (2013.01)

(58) Field of Classification Search

CPC ..... F04C 18/0215; F04C 28/26; F04C 28/24; F04C 28/265; F04C 29/126; F04C 29/128

USPC ..... 418/1, 55.1, 55.4, 55.5, 57, 180, 270; 137/625.33, 28; 251/63, 30.01, 30.02; 74/310.2

See application file for complete search history.

(56) References Cited

U.S. PATENT DOCUMENTS

| | | | | |
|---|---|---|---|---|
| 7,988,434 | B2 * | 8/2011 | Stover et al. | 418/55.5 |
| 8,313,318 | B2 * | 11/2012 | Stover et al. | 418/55.5 |
| 2011/0070114 | A1 * | 3/2011 | Milliff et al. | 418/1 |

* cited by examiner

*Primary Examiner* — Kenneth Bomberg
*Assistant Examiner* — Deming Wan
(74) *Attorney, Agent, or Firm* — Harness, Dickey & Pierce, P.L.C.

(57) ABSTRACT

A compressor including a housing defining a suction pressure region and a discharge pressure region includes first and second scroll members forming compression pockets. A first chamber located on the first end plate of the first scroll member includes first and second passages and a first aperture extending therethrough and in communication with the first chamber. The first aperture provides communication between a compression pocket and the first chamber. A modulation assembly is located in the first chamber and includes a heater and a thermal valve. The valve is displaceable from a first position that isolates the first passage from the second passage and a second position that permits communication between the first and second passages. The valve is displaced as a result of a temperature change provided by the heater.

18 Claims, 7 Drawing Sheets

CAPACITY MODULATED SCROLL COMPRESSOR

FIELD

The present disclosure relates to compressors, and more specifically to compressors having capacity modulation systems.

BACKGROUND

This section provides background information related to the present disclosure which is not necessarily prior art.

Scroll compressors include a variety of capacity modulation mechanisms to vary operating capacity of a compressor. The capacity modulation mechanisms may include fluid passages extending through a scroll member to selectively provide fluid communication between compression pockets and another pressure region of the compressor. Capacity modulation may be used to operate a compressor at full load or part load conditions. Requirement of full or part load variation depends on seasonal variation and occupants present in a conditioned space.

SUMMARY

This section provides a general summary of the disclosure, and is not a comprehensive disclosure of its full scope or all of its features.

A compressor may include a housing defining a suction pressure region and a discharge pressure region. A first scroll member may be supported within the housing and include a first end plate. A first spiral wrap may extend from a first side of the first end plate. A first chamber may be located on a second side of the first end plate and include a first and a second passage in selective communication therewith. A first aperture may extend through the first end plate and be in communication with the first chamber. A second scroll member may be supported within the housing and include a second end plate having a second spiral wrap extending therefrom. The second end plate may be meshingly engaged with the first spiral wrap to form a series of compression pockets. The first aperture may be in communication with one of the compression pockets to provide communication between the compression pocket and the first chamber. A modulation assembly may be located within the first chamber and comprise a heater and a valve. The valve may be displaceable between first and second positions. The valve may isolate the first passage from communication with the second passage when in the first position. The valve may provide communication between the first passage and the second passage when in the second position. The valve may be displaceable between the first and second positions as a result of a temperature change provided by the heater.

The compressor's first passage may be in communication with the suction pressure region.

The compressor's first passage may be in communication with the discharge pressure region.

The compressor's valve may be formed of bimetal.

The compressor's valve may selectively provide communication between the second passage and the suction pressure region.

The compressor may further comprise a floating seal assembly engaged with the housing and the first scroll member to isolate the discharge pressure region from the suction pressure region.

The compressor's heater is located axially between the floating seal assembly and the first end plate.

The compressor may further comprise a retainer that fixes the valve relative to the first scroll member.

The compressor's valve may be a thermal valve.

According to other features, the modulation assembly may be located within the first chamber and comprise a magnet that selectively magnetically couples with a movable member. The movable member may be displaceable between first and second positions. The movable member may block the first passage from communication with the second passage when in the first position. The movable member may provide communication between the first passage and the second passage when in the second position. The movable member may be displaceable between the first and second positions as a result of the magnet being energized. The movable member may comprise a metallic disk. The magnet may be an electromagnet located axially between a floating seal assembly and the first end plate.

According to still other features, the modulation assembly may be located in the first chamber and comprise a piston and a movable member. The piston may have a manifold defining a first series of apertures. The piston may slidably translate between first and second positions along a first cavity of a casing positioned in the first chamber. The casing may be define a second series of apertures. In the first position, the first and second series of apertures may be fluidly connected causing gas to urge the movable member into a position that precludes the first passage from communicating with the second passage. In the second position, the first and second series of apertures may be fluidly connected causing the movable member to move into a displaced position allowing gas to be fluidly connected from the first passage to the second passage. The casing may further comprise a bleed hole that fluidly connects the first and second passages when the piston is in the second position. The piston may be actuated between the first and second positions by a solenoid.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 10:
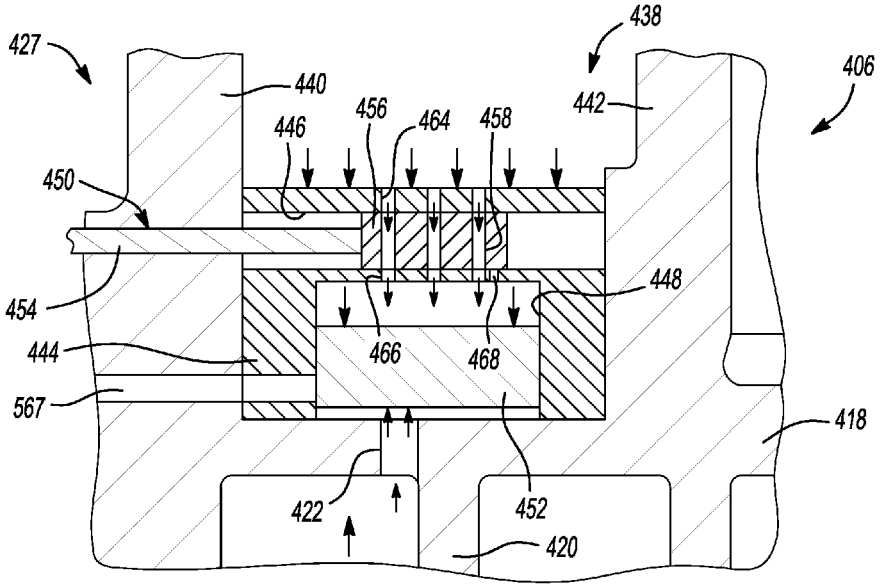
Figure 11:
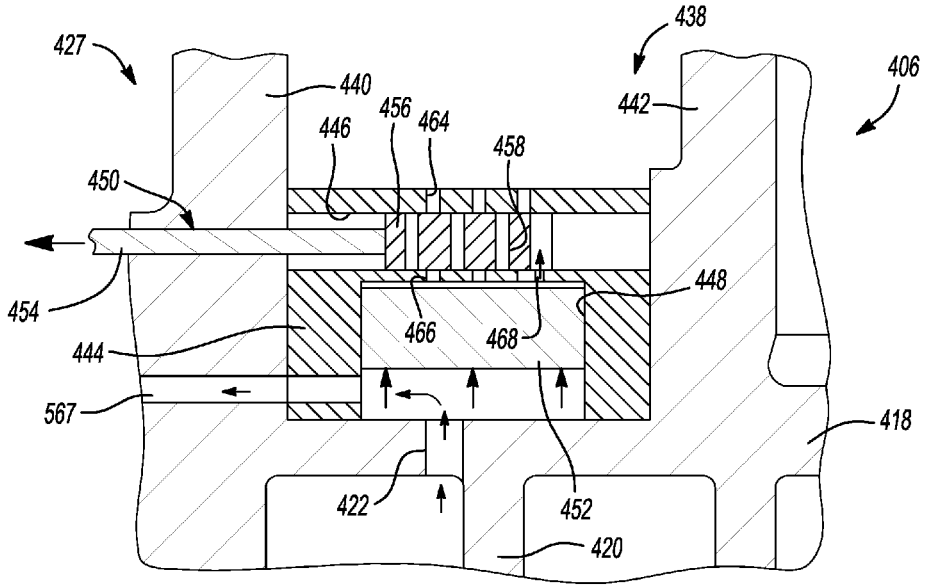
Figure 12:
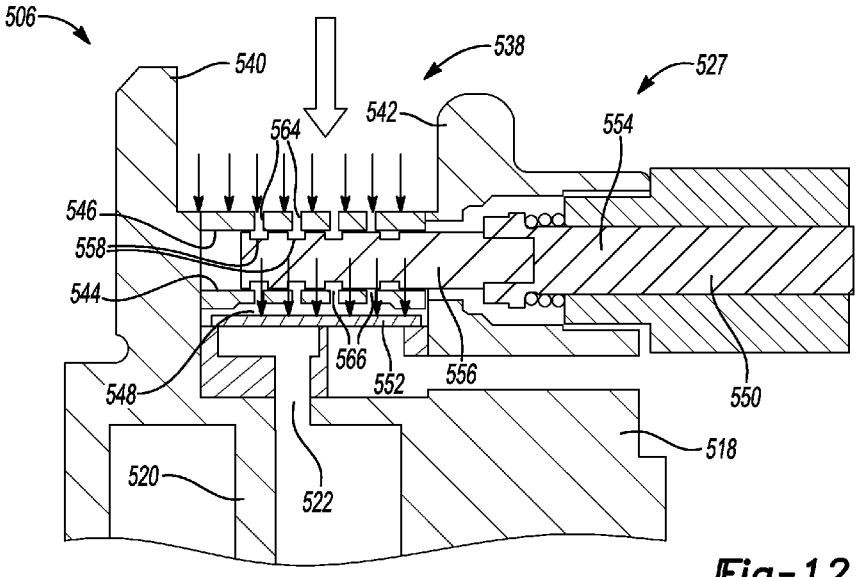
Figure 13:
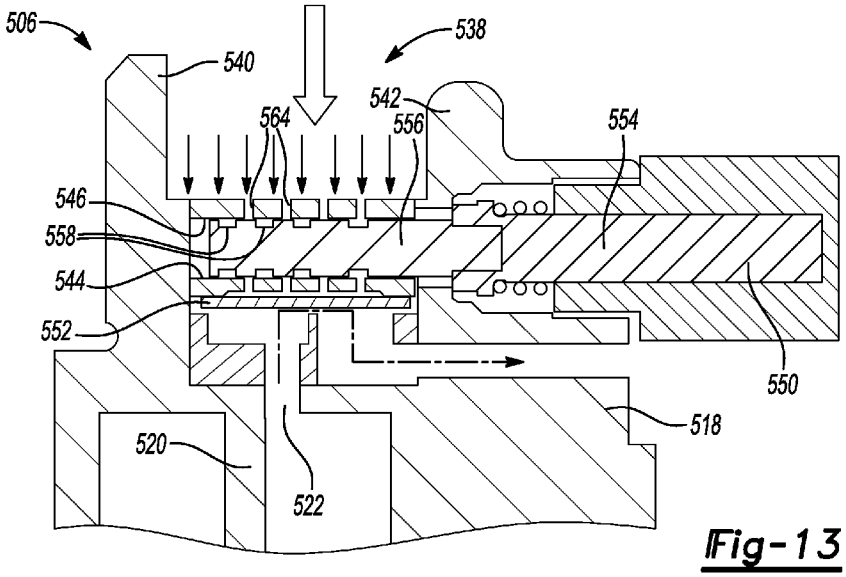

FIG. 10 is a cross-sectional view of a non-orbiting scroll incorporating a modulation assembly constructed in accordance to yet another example of the present disclosure, the modulation assembly including a solenoid piston and a stem manifold, the stem manifold shown located in a first position where a seal plate is translated to a position that closes the bypass port when the compressor is in a full load operating condition;

FIG. 11 is a cross-sectional view of the non-orbiting scroll of FIG. 10 and shown with the stem manifold of the modulation assembly translated to a second position where the seal plate is permitted to move to a second position that corresponds to the bypass port being open when the compressor is in a part load operating condition;

FIG. 12 is a cross-sectional view of a non-orbiting scroll incorporating a modulation assembly constructed in accordance to yet another example of the present disclosure, the modulation assembly including a solenoid piston and a stem manifold, the stem manifold shown located in a first position where a floating disk is translated to a position that closes a bypass port when the compressor is in a full load operating condition; and FIG. 13 is a cross-sectional view of the non-orbiting scroll of FIG. 12 and shown with the stem manifold of the modulation assembly translated to a second position where the floating disk is permitted to move to a second position that corresponds to the bypass port being open when the compressor is in a part load operating condition.

Corresponding reference numerals indicate corresponding parts throughout the several views of the drawings.

DETAILED DESCRIPTION

The following description is merely exemplary in nature and is not intended to limit the present disclosure, application or uses. It should be understood that throughout the drawings, corresponding reference numerals indicate like or corresponding parts and features.

The present teachings are suitable for incorporation in many types of different scroll and rotary compressors, including hermetic machines, open drive machines and non-hermetic machines. For exemplary purposes, a compressor 10 is shown as a hermetic scroll refrigerant-compressor of the low side type, i.e., where the motor and compressor are cooled by suction gas in the hermetic shell, as illustrated in the vertical section shown in FIG. 1.

Figure 1:
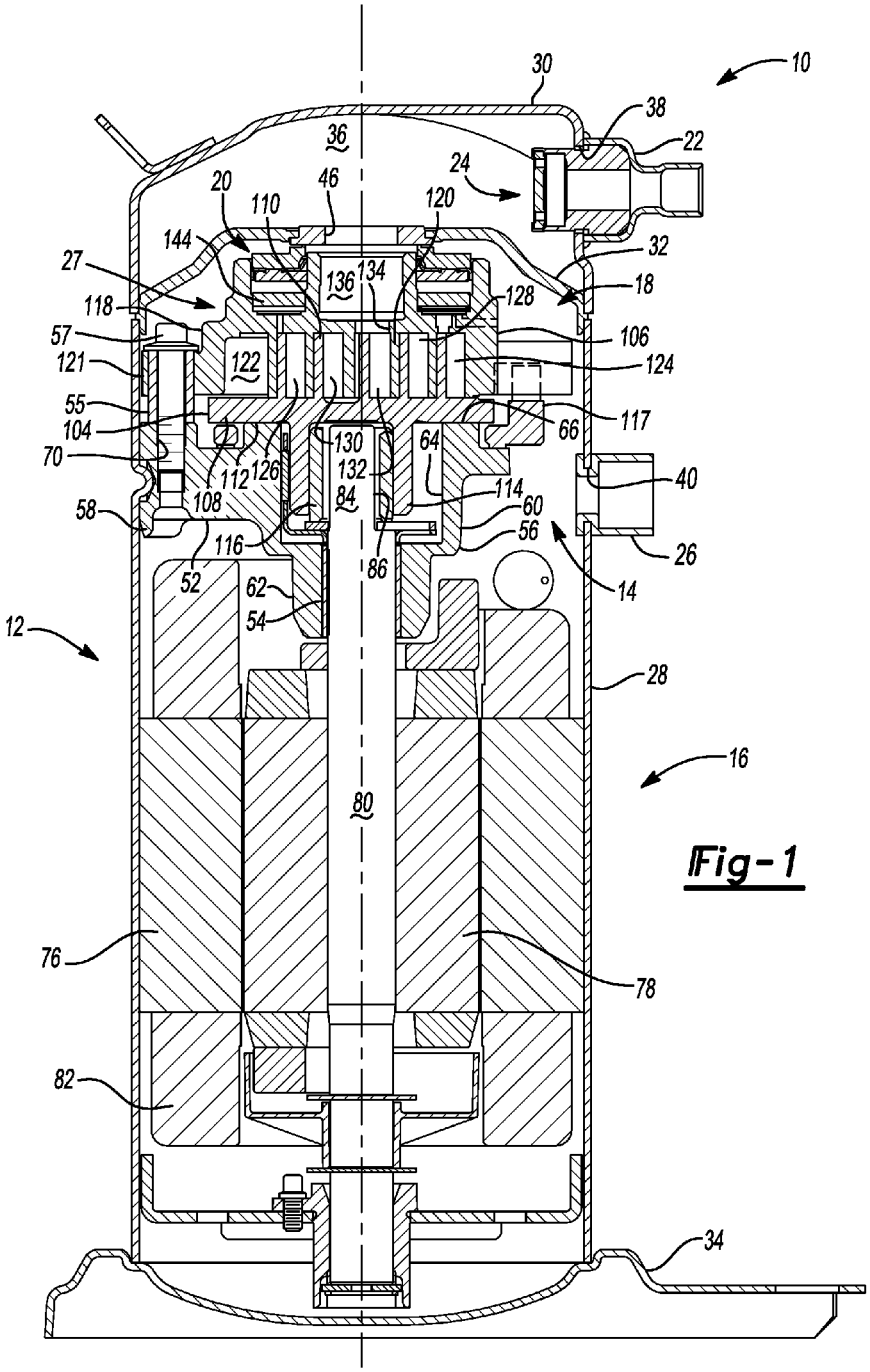
FIG. 1 is a sectional view of a compressor constructed in accordance to one example of the present disclosure.
Figure 2:
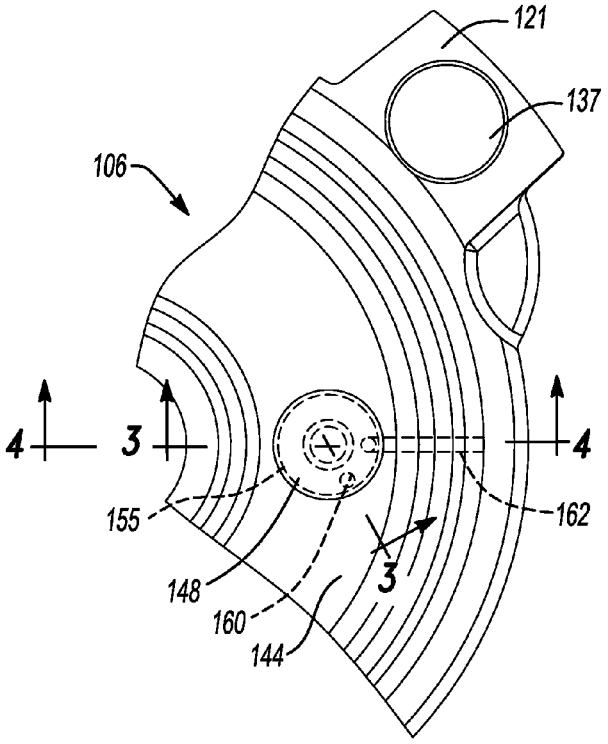
FIG. 2 is a partial plan view of a non-orbiting scroll member of the compressor of FIG. 1.
Figure 3:
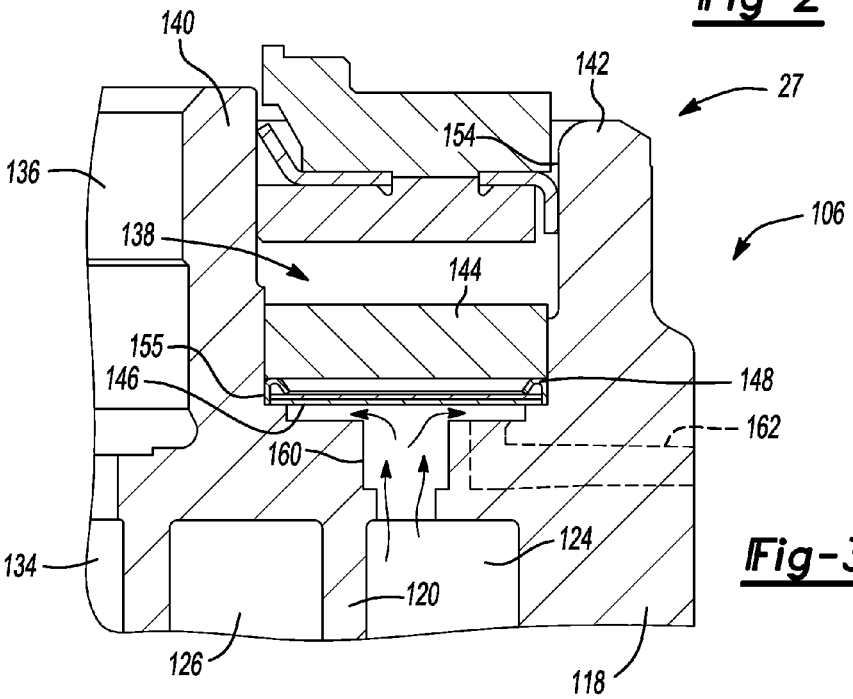
FIG. 3 is a cross-sectional view taken along line 3-3 of the non-orbiting scroll and a modulation system of the compressor of FIG. 2 and shown with a heater in an OFF position corresponding to the compressor operating in part load.
Figure 4:
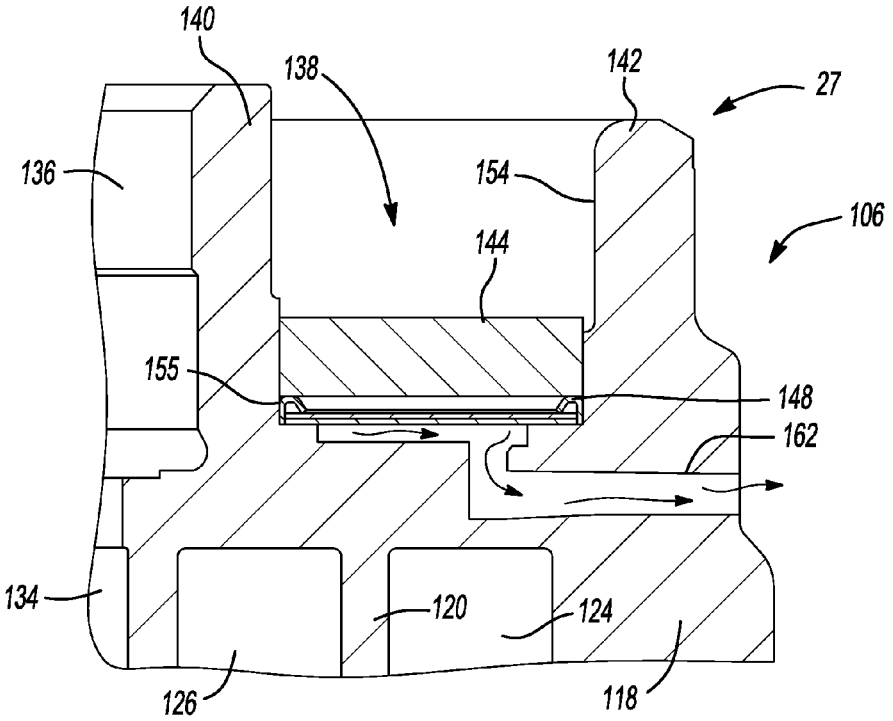
FIG. 4 is a cross-sectional view taken along line 4-4 of the modulation system of FIG. 3 and shown with the heater in the OFF position allowing fluid to flow through the bypass port and radial passage corresponding to the compressor operating in part load.

With initial reference to FIG. 1, the compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. The shell assembly 12 may house the main bearing housing assembly 14, the motor assembly 16, and the compression mechanism 18.

The shell assembly 12 may generally form a compressor housing and may include a cylindrical shell 28, an end cap 30 at the upper end thereof, a transversely extending partition 32, and a base 34 at a lower end thereof. The end cap 30 and the partition 32 may generally define a discharge chamber 36. The discharge chamber 36 may generally form a discharge muffler for the compressor 10. The refrigerant discharge fitting 22 may be attached to the shell assembly 12 at the opening 38 in the end cap 30. The discharge valve assembly 24 may be located within the discharge fitting 22 and may generally prevent a reverse flow condition. The suction gas inlet fitting 26 may be attached to the shell assembly 12 at the opening 40. The partition 32 may include a discharge passage 46 therethrough that provides communication between the compression mechanism 18 and the discharge chamber 36.

The main bearing housing assembly 14 may be affixed to the shell 28 at a plurality of points in any desirable manner, such as staking. The main bearing housing assembly 14 may include a main bearing housing 52, a first bearing 54 disposed therein, bushings 55, and fasteners 57. The main bearing housing 52 may include a central body portion 56 having a series of arms 58 that extend radially outwardly therefrom. The central body portion 56 may include first and second portions 60 and 62 having an opening 64 extending therethrough. The second portion 62 may house the first bearing 54 therein. The first portion 60 may define an inner flat thrust bearing surface 66 on an axial end surface thereof. The arm 58 may include apertures 70 extending therethrough that receive the fasteners 57.

The motor assembly 16 may generally include a motor stator 76, a rotor 78, and a drive shaft 80. Windings 82 may pass through the motor stator 76. The motor stator 76 may be press-fit into the shell 28. The drive shaft 80 may be rotatably driven by the rotor 78. The rotor 78 may be press-fit on the drive shaft 80. The drive shaft 80 may include an eccentric crank pin 84 having a flat 86 thereon.

The compression mechanism 18 may generally include an orbiting scroll 104 and a non-orbiting scroll 106. The orbiting scroll 104 may include an end plate 108 having a spiral vein or wrap 110 on the upper surface thereof and an annular flat thrust surface 112 on the lower surface. The thrust surface 112 may interface with the annular flat thrust bearing surface 66 on the main bearing housing 52. A cylindrical hub 114 may project downwardly from the thrust surface 112 and may have a drive bushing 116 rotatably disposed therein. The drive bushing 116 may include an inner bore in which the crank pin 84 is drivingly disposed. The crank pin flat 86 may drivingly engage a flat surface in a portion of the inner bore of the drive bushing 116 to provide a radially compliant driving arrangement. An Oldham coupling 117 may be engaged with the orbiting and non-orbiting scrolls 104, 106 to prevent relative rotation therebetween.

With additional reference now to FIGS. 2-5, the non-orbiting scroll 106 may include an end plate 118 having a spiral wrap 120 on a lower surface thereof and a series of radially outwardly extending flanged portions 121. The spiral wrap 120 may form a meshing engagement with the wrap 110 of the orbiting scroll 104, thereby creating an inlet pocket 122 (FIG. 1), intermediate pockets 124, 126, 128, 130, and an outlet pocket 132. The non-orbiting scroll 106 may be axially displaceable relative to the main bearing housing assembly 14, the shell assembly 12, and the orbiting scroll 104. The non-orbiting scroll 106 may include a discharge passage 134 in communication with the outlet pocket 132 and upwardly open recess 136 which may be in fluid communication with the discharge chamber 36 (FIG. 1) via the discharge passage 46 in the partition 32.

The flanged portions 121 may include openings 137 therethrough. Each opening 137 may receive a bushing 55 therein (FIG. 1). The respective bushings 55 may receive fasteners 57. The fasteners 57 may be engaged with the main bearing housing 52 and the bushings 55 may generally form a guide for axial displacement of the non-orbiting scroll 106. The fasteners 57 may additionally prevent rotation of the non-orbiting scroll 106 relative to the main bearing housing assembly 14. The non-orbiting scroll 106 may include an annular recess 138 in the upper surface thereof defined by parallel and coaxial inner and outer sidewalls 140, 142.

Seal assembly 20 may include a floating seal located within first annular recess 144. Seal assembly 20 may be axially displaceable relative to shell assembly 12 and non-orbiting scroll 106 to provide for axial displacement of non-orbiting scroll 106 while maintaining a sealed engagement with partition 32 to isolate discharge and suction pressure regions of compressor 10 from one another. More specifically, pressure within annular recess 132 may urge seal assembly 20 into engagement with partition 32 during normal compressor operation.

The modulation assembly 27 can further comprise a heater 144, a thermal valve 146, and a retainer 148. The heater 144 may be disposed within the annular recess 138 and may separate the annular recess 138 into first and second annular recesses 154 and 155. The heater 144 can be any component that provides heat such as, but not limited to, an electric heating element. The thermal valve 146 may be formed of a material that is configured to deflect as a result from temperature change. In the example provided, the thermal valve 146 is in the shape of a disk and formed of a bimetal material. The retainer 148 can be a metal clip or other structure that fixes a portion of the thermal valve 146 at the annular recess 138.

The first and second annular recesses 154 and 155 may be isolated from one another. A passage or bypass port 160 may extend through the end plate 118, placing the second recess 155 in communication with the intermediate fluid pocket 124. A radial passage 162 may be formed through the end plate 118 that is in fluid communication with the second recess 155. As will become appreciated from the following discussion, the heater 144 is configured to heat the thermal valve 146 to move the thermal valve 146 from the position shown in FIGS. 3 and 4 to the position shown in FIG. 5. Explained in greater detail, when the heater 144 is OFF, corresponding to the compressor 10 operating in a part load condition, the thermal valve 146 occupies a generally planar position shown in FIGS. 3 and 4 whereby fluid is permitted to flow through the bypass port 160 and the radial passage 162. When the thermal valve 146 is in the OFF position, the bypass port 160 and radial passage 162 may be in communication with a suction pressure region of the compressor 10 providing a reduced capacity operating mode.

Figure 5:
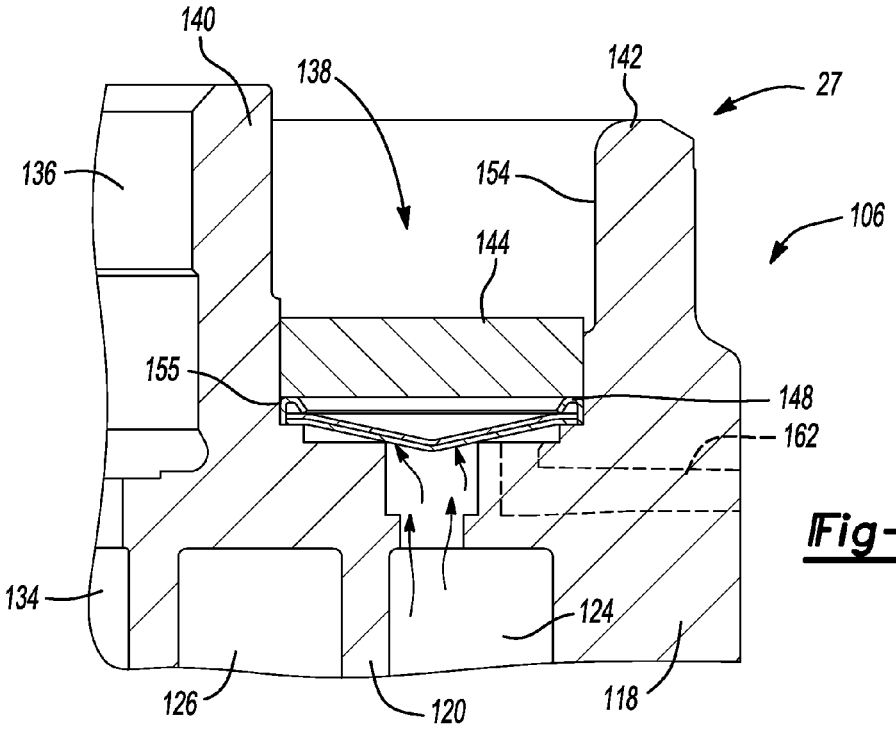
FIG. 5 is a cross-sectional view of the modulation assembly of FIG. 3 and shown with the heater in the ON position causing a valve member to deflect thereby blocking flow from passing from a bypass port to a radial passage corresponding to the compressor operating in a full load condition.

When the heater 144 is activated or turned to an ON position, the rise in temperature will cause the thermal valve 146 to generally deflect to the position shown in FIG. 5 thereby closing the bypass port 160 when the compressor 10 is in a full load operating condition. When the thermal valve 146 is in the position shown in FIG. 5, gas is precluded from flowing from the bypass port 160 to the radial passage 162 by the thermal valve 146. The bypass port 160 and radial passage 162 may be blocked from fluid communication with a suction pressure region of the compressor 10 providing a full capacity operating mode for the compressor 10.

Figure 6:
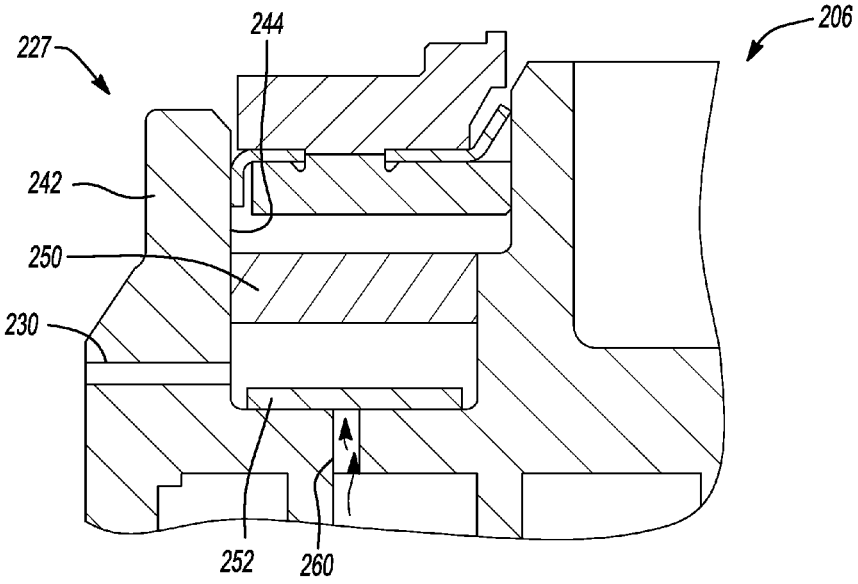
FIG. 6 is a cross-sectional view of a non-orbiting scroll that incorporates a modulation assembly constructed in accordance to additional features of present disclosure, the modulation assembly including a magnet and shown in an unenergized position causing a disk member to block flow from passing through the bypass port to the radial passage for a compressor in a full load operating condition.
Figure 7:
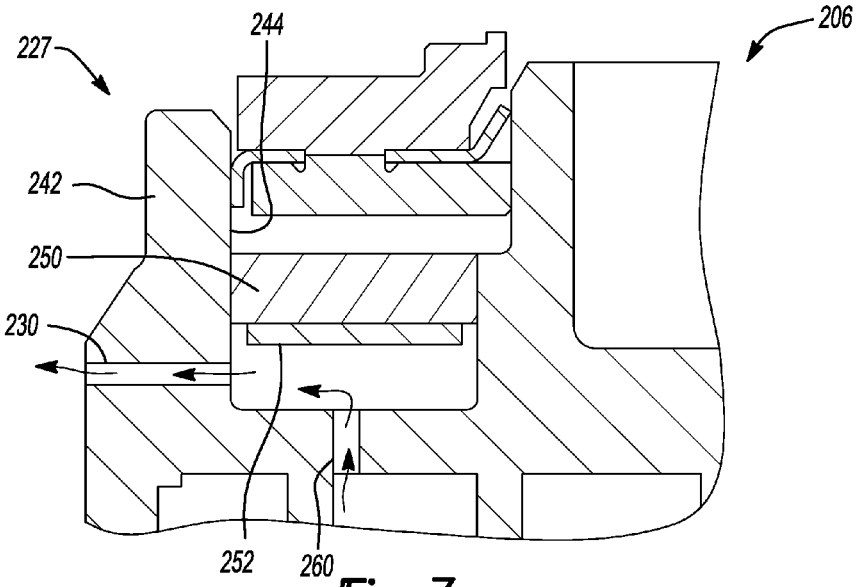
FIG. 7 is a cross-sectional view of the non-orbiting scroll of FIG. 6 and shown with the magnet of the modulation assembly energized causing the disk to magnetically couple to the magnet and allow fluid to flow through the bypass port and radial passage when the compressor is operating in a part load operating condition.

Turning now to FIGS. 6 and 7, an alternate non-orbiting scroll 206 and modulation assembly 227 are shown. The non-orbiting scroll 206 may be generally similar to the non-orbiting scroll 106 described above. Therefore, it is understood that the description of the non-orbiting scroll 106 applies equally to the non-orbiting scroll 206 with the exceptions indicated below. Further, it is understood that the non-orbiting scroll 206 and modulation assembly 227 may be incorporated into a compressor such as the compressor 10 in place of the non-orbiting scroll 106 and modulation assembly 27.

The non-orbiting scroll 206 may include a radial passage 230 that extends through an outer coaxial wall 242 into a first annular recess 244. The modulation assembly 227 may generally include a magnet 250 that selectively magnetically couples with a movable member or disk 252. The disk 252 can be formed of metallic material. It will be appreciated that the disk 252 may comprise any shape that suitably covers the bypass port 260 when uncoupled to the magnet 250. The magnet 250 is generally disposed within the first annular recess 244. The magnet 250 can be an electromagnet that can be selectively energized by a controller.

Operation of the modulation assembly 227 according to one example of the present disclosures will now be described. When the magnet 250 is unenergized, the disk 252 is permitted to occupy a position against the bypass port 260 as illustrated in FIG. 6. In this position, the disk 252 precludes flow through the bypass port 260 and can correspond to the compressor 10 being operated in a full load condition. When it is desirable to operate the compressor 10 in a part load condition, the magnet 250 is energized causing the disk 252 to be magnetically coupled to the magnet 250. Explained differently, the disk 252 is moved from the position shown in FIG. 6 to the position shown in FIG. 7 allowing flow from the bypass port 260 and out through the radial passage 230.

Figure 8:
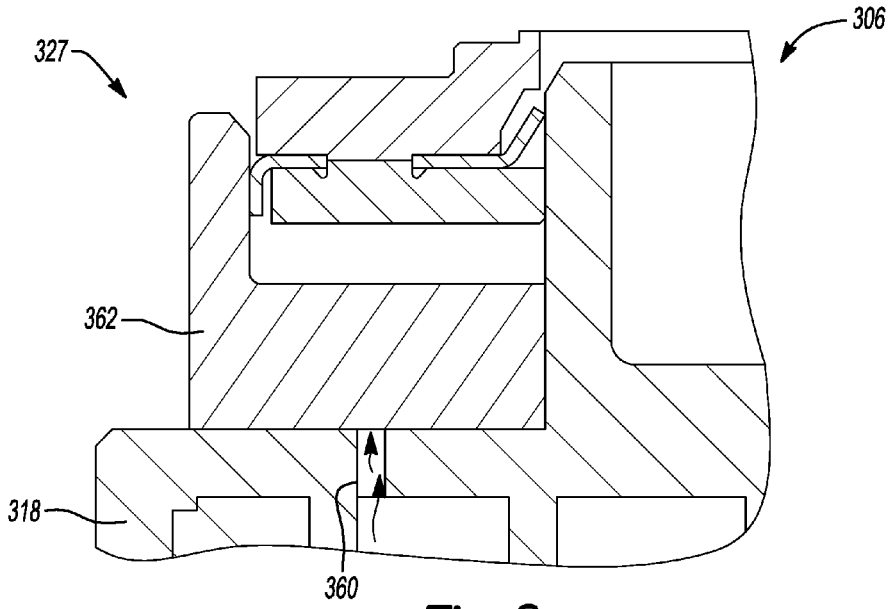
FIG. 8 is a cross-sectional view of a non-orbiting scroll that incorporates a modulation assembly constructed in accordance to another example of the present disclosure, the modulation assembly including a rotating hub shown rotationally aligned at a first position to block flow from passing through the bypass port to the radial passage when the compressor is operating in a full load condition.
Figure 9:
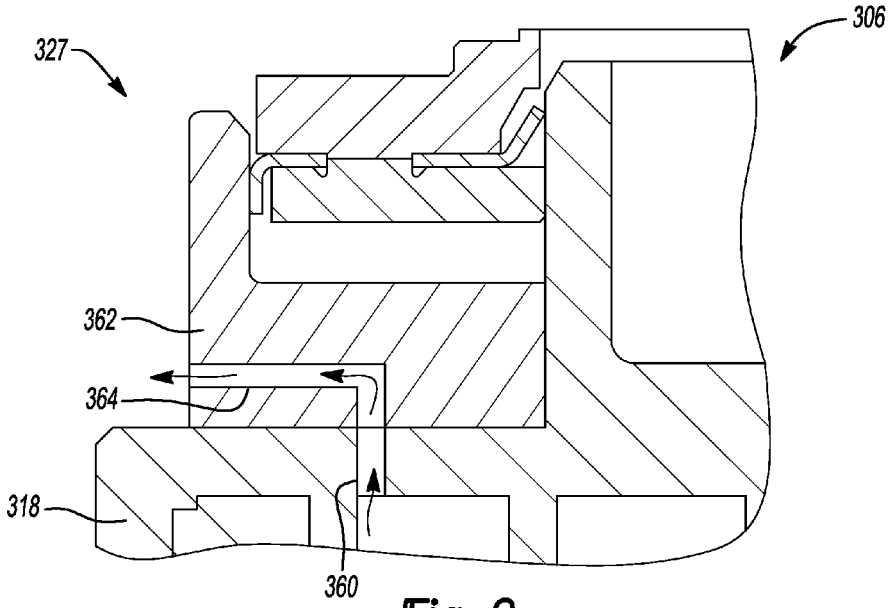
FIG. 9 is a cross-sectional view of the non-orbiting scroll of FIG. 8 and shown with the rotating hub of the modulation assembly rotated to a second position where a corresponding radial passage aligns with the bypass port when the compressor is in a part load operating condition.

Turning now to FIGS. 8 and 9, an alternate non-orbiting scroll 306 and modulation assembly 327 are shown. The non-orbiting scroll 306 may be generally similar to the non-orbiting scroll 106 described above. Therefore, it is understood that the description of the non-orbiting scroll 106 applies equally to the non-orbiting scroll 306 with the exceptions indicated below. Further, it is understood that the non-orbiting scroll 306 and modulation assembly 327 may be incorporated into a compressor such as the compressor 10 in place of the non-orbiting scroll 106 and modulation assembly 27.

The non-orbiting scroll 306 and end plate 318 having a spiral wrap 320 on a lower surface thereof. A bypass port 360 may extend through the end plate 318. The modulation assembly 327 can generally comprise a rotating hub 362 that defines a radial passage 364 formed therein. When the rotating hub 326 occupies a position shown in FIG. 8, the radial passage 364 is not aligned for fluid communication with the bypass port 360. Therefore, the compressor is operating in a full capacity mode. When the rotating hub 362 is rotated to the position shown in FIG. 9, the radial passage 364 is in fluid communication with the bypass port 360. Therefore, gas is free to flow through the bypass port 360 and the radial passage 364 providing a reduced capacity operating mode for the compressor 10.

With specific reference now to FIGS. 10 and 11, an alternate non-orbiting scroll 406 and modulation assembly 427 are shown. The non-orbiting scroll 406 may be generally similar to the non-orbiting scroll 106 described above. Therefore, it is understood that the description of the non-orbiting scroll 106 applies equally to the non-orbiting scroll 406 with the exceptions indicated below. Further, it is understood that the non-orbiting scroll 406 and modulation assembly 427 may be incorporated into a compressor such as the compressor 10 in place of the non-orbiting scroll 106 and modulation assembly 27. The non-orbiting scroll 406 may include an end plate 418 having a spiral wrap 420 on a lower surface thereof. The non-orbiting scroll 406 defines a bypass port 422. The non-orbiting scroll 406 may include an annular recess 438 in the upper surface thereof defined by parallel and coaxial inner and outer sidewalls 440, 442. The modulation assembly 427 can generally include a casing 444 that defines a first cavity 446 and a second cavity 448. The modulation assembly 427 can further comprise a solenoid piston 450 and a seal plate 452. The solenoid piston 450 can generally include a stem body 454 and stem manifold 456. The stem manifold 456 can define a plurality of passages 458 therethrough. The modulation assembly 427 may further comprise a bypass passage 567 that connects the lower portion of cavity 448 (i.e., portion below seal plate 452) to the suction pressure region of compressor 10. As will be described herein, the solenoid piston 450 may be configured to translate along the first cavity 446 between a first position shown in FIG. 10 to a second position shown in FIG. 11. The solenoid piston 450 can translate by way of a solenoid or other actuator. The seal plate 452 can be movably disposed within the second cavity 448.

The casing 444 can define a first plurality of passages 464 and a second plurality of passages 466. A bleed hole 468 may be formed through the casing 444. The bleed hole 468 may be used to allow trapped gas behind the seal plate 452 to escape to the suction side.

Operation of the modulation assembly 427 according to one example of the present disclosure will now be described. When the solenoid piston 450 occupies a position shown in FIG. 10, the passages 458 of the stem manifold 456 are aligned with the first and second plurality of passages 464 and 466 defined through the casing 444. In this regard, intermediate pressure acting on the casing 444 is permitted to flow through the first plurality of passages 464, the plurality of passages 458, and the second plurality of passages 466 to a location generally within the second cavity 448. As a result, the seal plate 452 is caused to translate toward the bypass port 422 such that the bypass port 422 is closed and the bypass passage 567 is closed by the wall of seal plate 452. In the position shown in FIG. 10, the compressor is operating in a full load condition.

With reference now to FIG. 11, the solenoid piston 450 has been translated in a direction generally leftward. When the solenoid piston 450 has been translated to the position shown in FIG. 11, the plurality of passages 458 defined in the stem manifold 456 are misaligned with the respective first and second plurality of passages 464 and 466 defined in the casing 444. Therefore, the intermediate pressure otherwise acting on the seal plate 452 is disconnected causing the seal plate 452 to lift up opening the bypass port 422 and opening the bypass passage 567. In this regard, the seal plate 452 is permitted to reciprocate in a direction generally upward due to a pressure differential caused by fluid flowing through the bypass port 422. Gas is permitted to escape through the bleed hole 468 to the suction side of the compressor. When the solenoid piston 450 occupies a position shown in FIG. 11, the compressor 10 operates in a part load condition.

With reference now to FIGS. 12 and 13, another non-orbiting scroll 506 and modulation assembly 527 are shown. The non-orbiting scroll 506 may be generally similar to the non-orbiting scroll 106 described above. Therefore, it is understood that the description of the non-orbiting scroll 106 applies equally to the non-orbiting scroll 506 with the exceptions indicated below. Further, it is understood that the non-orbiting scroll 506 and modulation assembly 527 may be incorporated into a compressor such as the compressor 10 in place of the non-orbiting scroll 106 and modulation assembly 27.

The non-orbiting scroll 506 may include an end plate 518 having a spiral wrap 520 on a lower surface thereof. The non-orbiting scroll 506 defines a bypass port 522. The non-orbiting scroll 506 may include an annular recess 538 in the upper surface and defined by parallel and coaxial inner and outer sidewalls 540 and 542. The modulation assembly 527 can generally include a casing 544 that defines a first cavity 546 and a second cavity 548. The modulation assembly 527 can further comprise a solenoid piston 550 and a floating disk 552. The solenoid piston 550 can generally include a stem body 554 and a stem manifold 556. The stem manifold 556 can define a plurality of passages 558 therethrough. As will be described herein, the solenoid piston 550 may be configured to translate along the first cavity 546 between a first position shown in FIG. 12 to a second position shown in FIG. 13. The solenoid piston 550 can translate by way of a solenoid or other actuator. The floating disk 552 can be movably disposed within the second cavity 548. The casing 544 can define a first plurality of passages 564 and a second plurality of passages 566.

Operation of the modulation assembly 527 according to one example of the present teachings will now be described. When the solenoid piston 550 occupies a position shown in FIG. 12, the passages 558 of the stem manifold 556 are aligned with the first and second plurality of passages 564 and 566 defined through the casing 544. In this regard, intermediate pressure acting on the casing 544 is permitted to flow through the first plurality of passages 564, the plurality of passages 558, and the second plurality of passages 566 to a location generally within the second cavity 548. As a result, the floating disk 552 is caused to translate toward the bypass port 522 such that the bypass port 522 is closed. In the position shown in FIG. 12, the compressor is operated in a full load condition.

With reference now to FIG. 13, the solenoid piston 550 has been translated in a direction generally leftward. When the solenoid piston 550 has been translated to the position shown in FIG. 13, the plurality of passages 558 defined in the stem manifold 556 are misaligned with the respective first and second plurality of passages 564 and 566 defined in the casing 544. Therefore, the intermediate pressure otherwise acting on the floating disk 552 is disconnected causing the floating disk 552 to lift up opening the bypass port 522. In this regard, the floating disk 552 is permitted to reciprocate in a direction generally upward due to a pressure differential caused by fluid flowing through the bypass port 522. When the solenoid piston 550 occupies a position shown in FIG. 13, the compressor 10 is operated in a part load condition.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a housing defining a suction pressure region and a discharge pressure region;

a first scroll member supported within said housing and including a first end plate, a first spiral wrap extending from a first side of said first end plate, a first chamber located on a second side of said first end plate having first and second passages in selective communication therewith, and a first aperture extending through said first end plate and in communication with said first chamber;

a second scroll member supported within said housing and including a second end plate having a second spiral wrap extending therefrom and meshingly engaged with said first spiral wrap to form a series of compression pockets, said first aperture being in communication with one of said compression pockets to provide communication between said compression pocket and said first chamber; and a modulation assembly located within said first chamber and comprising a piston and a movable member, said piston having a manifold defining a first series of apertures, wherein said piston slidably translates between first and second positions along a first cavity of a casing positioned in said first chamber, said casing defining a second series of apertures, wherein in said first position, said first and second series of aperture are fluidly connected causing gas to urge said movable member into a position that precludes said first passage from communicating with said second passage, wherein in said second position, said first and second series of apertures are fluidly disconnected causing said movable member to move into a displaced position allowing gas to be fluidly connected from said first passage to said second passage.

2. The compressor of claim 1, wherein said first passage is in communication with said suction pressure region.

3. The compressor of claim 1, wherein said second series of apertures is in communication with source of intermediate pressure fluid.

4. The compressor of claim 1 wherein said casing further comprises a bleed hole that fluidly connects said first and second passages when said piston is in said second position.

5. The compressor of claim 4, wherein said piston blocks said bleed hole in said first position to prevent fluid flow through said bleed hole and at least partially uncovers said bleed hole in said second position to allow fluid flow through said bleed hole.

6. The compressor of claim 1 wherein said piston is actuated between said first and second positions by a solenoid.

7. The compressor of claim 1, wherein said piston reciprocates relative to said casing in a radial direction.

8. The compressor of claim 7, wherein said movable member reciprocates relative to said casing in an axial direction perpendicular to said radial direction.

9. The compressor of claim 1, wherein said casing is disposed in an annular recess in said first end plate.

10. A compressor comprising:

a housing defining a suction pressure region and a discharge pressure region;

a first scroll member disposed within said housing and including a first end plate, a first spiral wrap extending from a first side of said first end plate, a first chamber located on a second side of said first end plate having a bypass port and a bypass passage in selective communication with each other, said bypass port extending through said first end plate and in communication with said first chamber;

a second scroll member supported within said housing and including a second end plate having a second spiral wrap extending therefrom and meshingly engaged with said first spiral wrap to form a series of pockets, said first aperture being in communication with one of said pockets to provide communication between said pocket and said first chamber; and a modulation assembly including a casing, a piston and a movable member, said casing partially defining said first chamber and a second chamber and including a first aperture and a second aperture, said first and second apertures disposed on opposite sides of said second chamber, said piston including a third aperture and reciprocating within said second chamber between a first position in which said first, second and third apertures are in communication with each other and a second position in which said third aperture is misaligned with said first and second apertures to prevent communication between said first and second apertures, said movable member disposed within said first chamber and movable in response to movement of said piston relative to said casing such that when said piston is in said first position, said first and second apertures are fluidly connected causing gas to urge said movable member into a position that restricts said bypass port from communicating with said bypass passage, and said first and second apertures are fluidly disconnected when said piston is in said second position causing said movable member to move into a displaced position that allows gas to be fluidly connected from said bypass port to said bypass passage.

11. The compressor of claim 10, wherein said bypass passage is in communication with said suction pressure region.

12. The compressor of claim 10, wherein said second aperture is in communication with a source of intermediate pressure fluid.

13. The compressor of claim 10, wherein said casing further comprises a bleed hole through which fluid can exit said first chamber when said piston is in said second position.

14. The compressor of claim 13, wherein said piston blocks said bleed hole in said first position to prevent fluid flow through said bleed hole and at least partially uncovers said bleed hole in said second position to allow fluid flow through said bleed hole.

15. The compressor of claim 10, wherein said piston is actuated between said first and second positions by a solenoid.

16. The compressor of claim 10, wherein said piston reciprocates relative to said casing in a radial direction.

17. The compressor of claim 16, wherein said movable member reciprocates relative to said casing in an axial direction perpendicular to said radial direction.

18. The compressor of claim 10, wherein said casing is disposed in an annular recess in said first end plate.

* * * * *